United States Patent [19]

Fredman et al.

[11] 4,146,940

[45] Apr. 3, 1979

[54] BED RAILS WITH CROSS WIRE

[76] Inventors: Harry Fredman; Irving Fredman, both of 908 SW. Washington, Peoria, Ill. 61602

[21] Appl. No.: 827,444

[22] Filed: Aug. 23, 1977

[51] Int. Cl.[2] ..... A47C 17/86

[52] U.S. Cl. ..... 5/9 B; 5/238; 5/286

[58] Field of Search ..... 5/296, 286, 279 B, 238, 5/9 B, 9 R; 403/244, 245

[56] References Cited

U.S. PATENT DOCUMENTS

| | | | |
|---|---|---|---|
| 2,099,621 | 11/1937 | Prescott | 5/9 B |
| 3,118,151 | 1/1964 | Fredman | 5/238 |
| 3,761,970 | 10/1973 | Fredman | 5/296 |
| 3,961,381 | 6/1976 | Weinhart et al. | 5/238 |

*Primary Examiner*—Kenneth J. Dorner

*Attorney, Agent, or Firm*—Clarence A. O'Brien; Harvey B. Jacobson

[57] ABSTRACT

Bed rails of the type disclosed in prior U.S. Pat. Nos. 3,118,151, issued Jan. 21, 1964, and Re. 27,182, issued Sept. 21, 1971, in which inwardly extending horizontal flanges underlie and form the sole support for a spring assembly with the flanges being interconnected by a tension member at the central portions of the rails to prevent outward deflection thereof for maintaining the horizontal flanges in underlying relation to the spring assembly. The tension member is in the form of a cross wire or cross wire assembly having hook-shaped ends associated with a downwardly offset apertured portion of the horizontal flanges of the bed rails with the hook-shaped ends being constructed so that they can be assembled only from the underside of the horizontal flanges, thereby assuring that the terminal ends of the hook-shaped ends will be disposed within the recesses formed in the upper surface portion of the horizontal flanges, for precluding any possible injury due to inadvertent contact with the free ends of the hook-shaped ends of the cross wire.

3 Claims, 3 Drawing Figures

BED RAILS WITH CROSS WIRE

BACKGROUND OF THE INVENTION

1. Field of the Invention

The present invention generally relates to a bed assembly including bed rails interconnected at their central portions by a cross wire assembly having terminal ends connected with the inwardly extending horizontal supporting flange on each of the bed rails with the horizontal flange forming a support for engaging a bed spring assembly and including a depressed or offset portion associated with a hook-shaped end on the cross wire so that the hook-shaped end can only be assembled with the offset portion by inserting it from the underside so that the free end of the hook-shaped end is disposed in the recess or offset portion in the upper surface of the horizontal flange and the portion of the cross wire underlying the horizontal flange is continuous and provided with relatively smooth contour surfaces to prevent injury in the event of inadvertent engagement therewith.

2. Description of the Prior Art

In prior U.S. Pat. Nos. 3,118,151 issued Jan. 21, 1964 and Re. 27,182 issued Sept. 27, 1971, there is disclosed a structure which includes bed rails interconnected by a central tension member in which the bed rails each include an inwardly extending bottom flange engaged by a hook-shaped end on the tension member. This structure eliminated the use of bed slats with the tension member preventing outward deflection of the bed rails and maintaining the flanges in underlying supporting engagement with the bed spring assembly, resulting in many benefits and advantages as set forth in the aforementioned patents which are incorporated herein by reference thereto. Also, the prior art cited during prosecution of the applications which matured into the aforementioned patents is incorporated herein by reference thereto.

The slatless bed assembly disclosed in the aforementioned patents has been further developed by the use of a tension wire forming the tension member with a predetermined length of wire of one-piece construction being used for a twin size bed assembly and a shorter fixed length of wire or wire rod being provided for use in combination with the longer wire when used with a double size bed assembly. Other appropriate length wires may be provided for use with other standard width beds. The cross wires or wire rods have a circular cross-sectional configuration and the ends thereof are reversely bent to form substantially identical hook-shaped ends which can be easily assembled with respect to each other and easily connected to the inwardly extending bottom flanges on the bed rails. In some instances, when the hook-shaped ends of the cross wire or cross wire assembly have been connected with the inwardly extending horizontal flanges, the hooking engagement has been such that the terminal free end of each hook-shaped end is disposed below the horizontal flange, thus resulting in an exposed relatively sharp edge formed by the end edge of the cross wire which is of generally circular cross-sectional configuration. This exposed end edge can possibly cause an injury if a person inadvertently strikes or otherwise comes into contact therewith. For example, if the cross wire and bed rail assembly is used in a bunk bed assembly and the upper set of bed rails are connected by the cross wire in such a manner that the free end is exposed along the undersurface of the horizontal flanges, a person occupying the bottom bed can inadvertently strike his head against the exposed end edge especially if he sets up in bed or sets on the side edge of the lower bed.

SUMMARY OF THE INVENTION

An object of the present invention is to provide bed rails interconnected by a cross wire in which each bed rail includes an inwardly extending horizontal bottom edge flange having a downwardly offset portion and an aperture therein adapted to receive a hook-shaped end on the cross wire with the construction of the horizontal flange and the hook-shaped end on the cross wire being such that the hook-shaped end can be assembled with respect to the horizontal flange only by inserting the hook-shaped end into the aperture provided therefor from the underside of the horizontal flange, thereby assuring that the free end of the hook-shaped end will be disposed above the horizontal flange thereby preventing any possible inadvertent contact with the free end of the hook-shaped end portion of the cross wire.

Another object of the invention is to provide bed rails and a cross wire having hook-shaped ends engageable with an inwardly extending bottom edge flange on each bed rail with the flange having a downwardly offset portion receiving the free end of the hook-shaped end portions on the cross wire with the cross wire itself underlying the horizontal flanges thereby providing a smooth external surface to prevent accidental injury and also to orient the cross wire in spaced relation below the bed spring assembly supported directly on the horizontal flanges of the bed rails.

A further object of the invention is to provide bed rails and a cross wire assembly as set forth in the preceding objects which is quite simple to assembly but constructed in a manner to prevent assembly in any manner other than connecting the hook-shaped ends on the wire rod to the bed rails by insertion of the hook-shaped ends from the underside of the horizontal flanges on the bed rails.

These together with other objects and advantages which will become subsequent apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
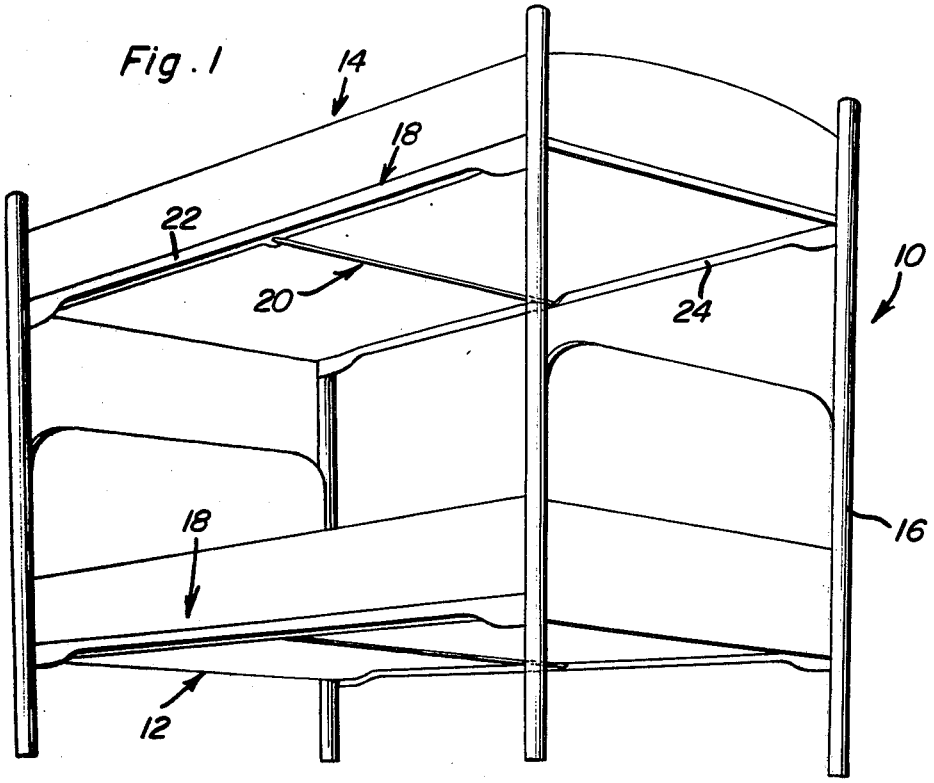
FIG. 1 is a perspective view of a bunk bed illustrating the bed rails and cross wire assembly of the present invention incorporated therein.

A bunk bed assembly is generally designated by reference numeral 10 in FIG. 1 and includes the usual lower bed assembly 12 and upper bed assembly 14 supported by corner support members 16. The bunk bed assembly 10 is schematically illustrated with each bed assembly including a bed spring assembly, mattress and other bedding and may be provided with a headboard, footboard, or the like, the details of which are not significant to the present invention. Each bed assembly 12 and 14 includes a pair of side rails 18 which generally are constructed in accordance with the disclosure in prior U.S. Pat. Nos. 3,118,151 and Re. No. 27,182 with the bed rails being prevented from lateral deflection by a cross wire generally designated by numeral 20.

Each bed rail 18 includes a vertical outer flange 22 and a horizontal, inwardly extending bottom flange 24 with each flange including a rib or channel 26 formed therein for rigifying the major length portion of the bed rail 18 but yet enabling the end portions of the bed rail 18 to flex in the manner set forth in the aforementioned patents.

The central portion of each horizontal flange 24 is provided with a downwardly offset portion 28 which extends through the rib or channel 26 with the inner wall of the rib or channel 26 being provided with a laterally opening aperture 30.

The cross wire 20 is in the form of a substantially rigid wire rod 32 having a circular cross-sectional configuration and provided with a generally U-shaped reverse bend 34 at each end thereof, thereby defining hook-shaped ends generally designated by numeral 36. The hook-shaped end 36 terminates in a free end 38 of a circular configuration which is spaced from the wire rod 32 a distance generally equal to the diameter of the curved or reversely bent portion 34. As illustrated, the length of the hook-shaped end from bend 34 to free end 38 is substantially the same as the distance between the laterally opening aperture 30 and the edge of the flange 24 so that the free end 38 generally coincides with the edge of the flange 24 and is completely received within the downwardly offset portion 28 thereby eliminating any possibility that the hook-shaped end 36 will cause deflection of the spring assembly 40 supported on the flange 24.

Figure 2:
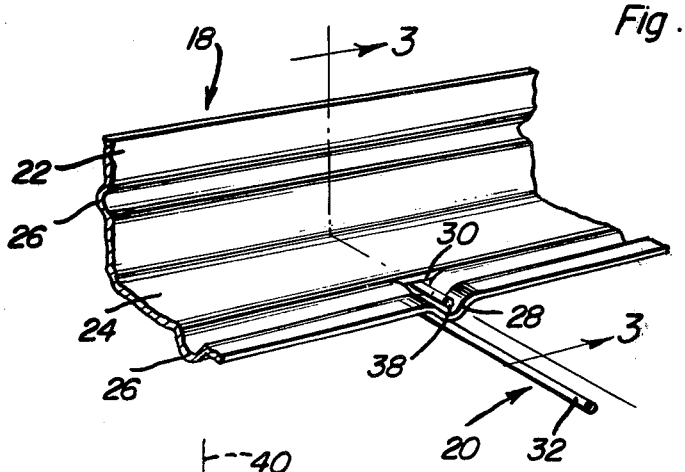
FIG. 2 is a fragmental, perspective view of the central portion of one of the bed rails and wire rod assembled therewith.
Figure 3:
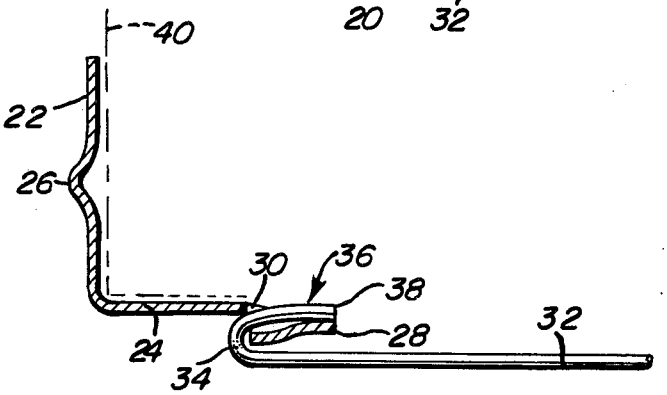
FIG. 3 is a sectional view taken substantially upon a plane passing along section line 3—3 of FIG. 2 illustrating the structural details of the bed rail flange and the associated hook-shaped end of the cross wire.

As illustrated in broken lines in FIG. 3, the spring assembly 40 is engaged with the inner surface of the flange 22 and the upper surface of the flange 24 with the cross wire 20 preventing outward deflection of the bed rails 18 thereby maintaining a snug engagement between a major portion of the length of the bed rails 18 and the bed spring assembly 40. The length of the hook-shaped end 36 and the radius of curvature of the reverse bend 34 as well as the dimensional characteristics of the offset portion 28 and the aperture 30 are such that the hook-shaped end 36 of the wire rod 32 cannot be assembled or connected to the flange 24 other than by inserting the free end 38 through the aperture 30 with the wire rod 32 disposed in underlying relation to the flange 24. Any effort by a person setting up a bed utilizing the present invention to insert or connect the hook-shaped end 36 with the flange 24 in any manner other than that illustrated in FIGS. 2 and 3 will be thwarted by the specific structural details and dimensional characteristics of the lanced opening 30, the dimensions of the downwardly offset portion 28 and the dimensions and rigidity characteristics of the hook-shaped end 36 of the cross wire 20. Thus, when the cross wire 20 is assembled with the bed rails 18, the free end 38 will be disposed above the upper surface of the offset portion 28 in the flange 24 to prevent any possible inadvertent contact and possible accidental injury therefrom even if a person setting on the side of the lower bed 12 strikes his head against the bottom of the bed rail 18 of the upper bed 14 where the cross wire 20 is hooked. The reverse bend 34 of the cross wire 20 also prevents contact with the free edge portion of the lower edge of the opening 30 as illustrated in FIG. 3, thus further precluding the possibility of accidental injury. The wire rod 20 is constructed of a metallic material having hardness characteristics which precludes the opening up of or bending of the hook-shaped end 36 by use of a screw driver, pliers, or the like, which tools are normally available to a person setting up a bed, whether it be a purchaser-owner, furniture store employee, or the like.

While a twin size bed assembly 10 has been illustrated, the invention may be used with various size beds by employing cross wires 20 of different lengths or by providing a longer and shorter cross wire each having hook-shaped ends so that for a twin size bed assembly, only a longer cross wire 20 is used and when a double size bed is to be assembled, a longer and a shorter cross wire may be used to provide an aggregate length required for a double bed. The assembly may also be used with queen or king size beds or any other standard bed width. The consealment on the free end 38 of the hook-shaped end 36 within the confines of the downwardly offset portion 28 not only eliminates any possible projections engaged by the spring assembly and precludes injury due to inadvertent contact therewith, but also avoids contact between bedding and the sharp free end 38 and precludes contact of cleaning implements, and the like, which could occur when the free end 38 is exposed to the undersurface of the flange 24 especially where bedding is supported a relatively short distance above the floor surface so that it is sometimes difficult to insert vacuum cleaner heads, and the like, under the bed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A bunk bed assembly comprising a top bed and a bottom bed wherein at least said top bed comprises a pair of side rails supporting a spring assembly therebetween with each of the side rails including a horizontal flange having an inner edge extending longitudinally of said flange and disposed in facing relation to the inner edge of the other of said flanges and extending under and directly supporting the spring assembly, a tension member interconnecting the horizontal flanges to prevent outward deflection of the side rails, the improvement comprising each horizontal flange including a downwardly offset portion in the central area thereof and a laterally opening aperture at the end of the offset portion, said tension member being in the form of a wire having a reversely bent end portion defining a hook-shaped end engageable through the aperture and with the downwardly offset portion by engaging the hook-shaped end with the horizontal flange from a position below the horizontal flange, wherein said laterally opening aperture is dimensioned in relation to said hook-shaped end to preclude assembly of the wire with the horizontal flange by insertion from the upper surface of the horizontal flange, and wherein said horizontal flange is provided with a longitudinal reinforcing rib of generally channel shaped configuration extending lengthwise in the flange in adjacent but spaced relation to the inner edge thereof, said offset portion extending from the inner edge of the horizontal flange to the distal wall of the rib, said aperture being formed in the distal wall of the rib and being shaped generally as a continuation of the offset portion of the flange, the hook-shaped end of the wire extending through said aperture.

2. The structure as defined in claim 1 wherein said wire has a generally circular cross-sectional configuration and the hook-shaped end terminates in a free end generally perpendicular to the longitudinal axis of the wire, said free end being disposed generally in alignment with a portion of the upper surface of the offset portion of the flange thereby preventing contact of the free end with the underside of the bed.

3. The structure as defined in claim 2 wherein the vertical dimension of the offset portion of the flange is at least equal to the height of the free end of the wire thereby preventing supporting contact between the hook-shaped end and a bed spring assembly supported by the flange.

* * * * *